US010602899B1

(12) United States Patent
Ebrahimi Afrouzi

(10) Patent No.: US 10,602,899 B1
(45) Date of Patent: Mar. 31, 2020

(54) BRUSH WITH PRESSURE SENSOR

(71) Applicant: Ali Ebrahimi Afrouzi, San Jose, CA (US)

(72) Inventor: Ali Ebrahimi Afrouzi, San Jose, CA (US)

(73) Assignee: AI Incorporated, Toronto (CA)

( * ) Notice: Subject to any disclaimer, the term of this patent is extended or adjusted under 35 U.S.C. 154(b) by 224 days.

(21) Appl. No.: 15/791,788

(22) Filed: Oct. 24, 2017

Related U.S. Application Data

(60) Provisional application No. 62/404,478, filed on Oct. 5, 2016.

(51) Int. Cl.

| | |
|---|---|
| ***A47L 9/28*** | (2006.01) |
| ***A46B 15/00*** | (2006.01) |
| ***A46B 13/00*** | (2006.01) |
| ***A47L 9/04*** | (2006.01) |
| ***B08B 1/04*** | (2006.01) |
| ***B08B 1/00*** | (2006.01) |
| ***A47L 11/40*** | (2006.01) |

(52) U.S. Cl.
CPC ..... *A47L 9/2847* (2013.01); *A46B 13/001* (2013.01); *A46B 15/0002* (2013.01); *A46B 15/0012* (2013.01); *A47L 9/0477* (2013.01); *A47L 11/4041* (2013.01); *B08B 1/002* (2013.01); *B08B 1/04* (2013.01); *A47L 2201/00* (2013.01); *A47L 2201/04* (2013.01); *A47L 2201/06* (2013.01)

(58) Field of Classification Search
CPC ..... A46B 7/10; A46B 13/00; A46B 13/001; A46B 13/003; A46B 13/005; A46B 13/006; A46B 13/02; A46B 15/0002; A46B 15/0004; A46B 15/0012; B08B 1/002; B08B 1/04; A47L 9/0477; A47L 9/2847; A47L 11/4041
USPC ..... 15/179, 21.1, 23, 50.3, 52.1, 53.2, 53.3, 15/82, 319, 339, 340.3, 366, 383
See application file for complete search history.

(56) References Cited

U.S. PATENT DOCUMENTS

| | | | | |
|---|---|---|---|---|
| 4,207,642 | A * | 6/1980 | Arato | B60S 3/066 15/179 |
| 5,592,710 | A * | 1/1997 | Wanner | A46B 13/001 15/53.2 |
| 5,940,927 | A | 8/1999 | Haegermarck et al. | |
| 6,605,156 | B1 | 8/2003 | Clark et al. | |
| 7,599,758 | B2 | 10/2009 | Reindle et al. | |
| 8,600,553 | B2 | 12/2013 | Svendsen et al. | |
| 9,457,471 | B2 | 10/2016 | Schnittman et al. | |
| 2005/0278888 | A1 | 12/2005 | Reindle et al. | |
| 2010/0313910 | A1 | 12/2010 | Lee et al. | |
| 2017/0080570 | A1 | 3/2017 | Schnittman et al. | |

* cited by examiner

*Primary Examiner* — Mark Spisich

(57) ABSTRACT

A rotatable brush with a pressure sensor. The pressure sensor comprises a projecting blade connected to a tactile sensor by a flexible member. The projecting blade extends along the length of the shaft and is housed among the plurality of bristles protruding radially from the shaft. The projecting blade compresses the flexible member when pressure around the brush reaches a predetermined threshold. Upon compression of the flexible member, the tactile sensor, electronically coupled with a processor or controller, is activated thereby triggering a variety of possible preprogrammed responses.

20 Claims, 5 Drawing Sheets

BRUSH WITH PRESSURE SENSOR

CROSS-REFERENCE TO RELATED APPLICATIONS

This application claims the benefit of provisional patent application Ser. No. 62/404,478, filed Oct. 5, 2016 by the present inventor.

FIELD OF INVENTION

The present invention relates to brushes for cleaning surfaces, and more particularly, to robotic vacuum cleaner brushes.

BACKGROUND OF INVENTION

During operation robotic vacuum cleaners may encounter obstructions on the working surface which can become entangled in the robotic vacuum brush. These occurrences can keep robotic vacuum cleaners from completing their task and may cause damage to the device if not immediately detected. In prior art, the amount of current generated by a separate brush motor has been used to detect entanglement with an obstruction as the power required and the current generated in rotating the brush would increase if entanglement occurred. Once entanglement is detected the brush is programmed to stop and reverse direction until the current is below a certain threshold, at which time the robotic device may resume operation. However, an increase in the current generated by the brush motor may occur for reasons other than an entanglement with an obstruction, resulting in false detection of a brush entanglement. For example, when operating on a thick pile carpet the current generated by the brush motor may increase because more power is required to rotate the brush through thick pile carpet. This may trigger the brush motor to stop and the brush to operate in the reverse direction when not needed. A need exists for a more accurate method to identify entanglements on vacuum brushes.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

It is the goal of the present invention to introduce a robotic vacuum cleaner brush with a protection mechanism comprising a pressure sensor and a tactile sensor capable of detecting entanglement with an obstruction and initiating a preprogrammed response. Entanglement with an obstruction can occur when, for example, a robotic vacuum cleaner drives over an electrical cord during operation.

The above stated goal is achieved by a rotatable brush with a pressure sensor connected to a tactile sensor by a flexible member. The pressure sensor, a projecting blade extending along the length of the shaft and housed among the plurality of brush bristles protruding radially, compresses the flexible member when pressure around the brush reaches a predetermined threshold. Upon compression of the flexible member, the tactile sensor, electronically coupled with a processor and/or controller, is activated and a variety of responses can be programmed to occur. Responses include any of: halting rotation of the brush, reversing rotation of the brush, temporarily reversing rotation of the brush, turning off a device containing the brush, activating an alert on a device containing the brush, and altering the operation of a device containing the brush in any other way. In some embodiments, responses are triggered only after the sensor has been actuated for a predetermined length of time.

BRIEF DESCRIPTION OF DRAWINGS

Non-limiting and non-exhaustive features of the present invention are described with reference to the following figures, wherein like reference numerals refer to like parts throughout the various figures.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details.

As understood herein, the term "robot" or "robotic device" may be defined generally to include one or more autonomous devices having communication, mobility, and/or processing elements. For example, a robot or robotic device may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., and one or more clock or synchronizing devices.

The present invention proposes a rotatable brush with a protection mechanism. The brush comprises a shaft with a plurality of bristles protruding radially therefrom. The protection mechanism comprises a pressure sensor comprising a projecting blade extending along the length of the shaft connected thereto by a flexible member attached to a tactile sensor. When pressure around the brush reaches a predetermined threshold, the projecting blade will force the connecting flexible member to compress and actuate the tactile sensor. The tactile sensor is electronically coupled with a processor or controller so that when the tactile sensor is actuated, a variety of responses are programmed to occur. Responses include any of halting rotation of the brush, reversing rotation of the brush, temporarily reversing rotation of the brush, slowing rotation of the brush, pausing rotation of the brush, turning off a device containing the brush, activating an alert on a device containing the brush, and altering the operation of a device containing the brush in any other way. In some embodiments, responses are triggered only after the sensor has been actuated for a predetermined length of time.

It will be obvious to persons skilled in the art that such a brush can be used in various types of surface cleaning devices, such as, but not limited to, robotic vacuum cleaners, upright vacuum cleaners, or other surface cleaning devices.

A projecting bar, projecting tabs or other projecting members can be employed instead of a projecting blade without departing from the scope of the invention so long as the form of the projecting member allows it to transfer pressure caused by an entanglement around the brush to the tactile sensor.

Various types of mechanical or electronic pressure sensors or pressure-actuated switches can be employed as the tactile sensor.

Figure 1A:
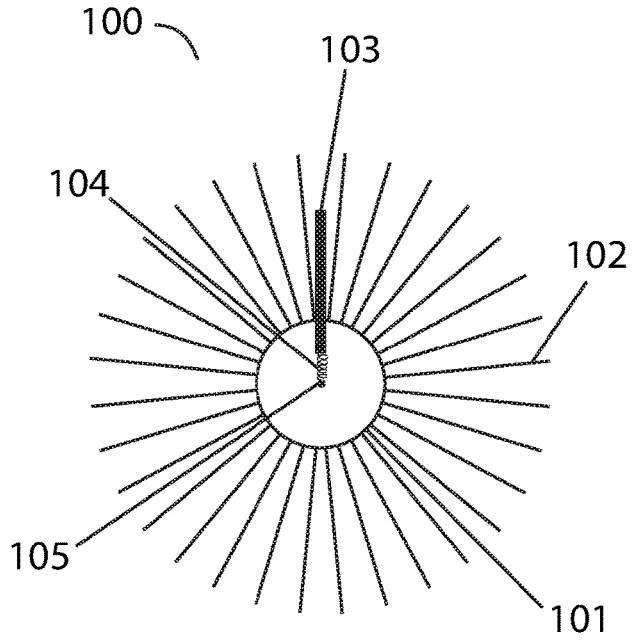
FIG. 1A illustrates a cross sectional view of a robotic vacuum brush with a pressure sensor embodying features of the present invention.

Referring to FIG. 1A, a cross sectional side view of brush 100 is illustrated. Brush 100 is comprised of shaft 101 and plurality of bristles 102 projecting radially outward from shaft 101. Projecting blade 103 is disposed along the length of the shaft and projects through an aperture in the shaft (not shown). Projecting blade 103 is attached to tactile sensor 105 via one or more flexible members 104. In some embodiments, the one or more flexible members 104 are comprised of springs. Projecting blade 103 is positioned such that any force imposed on it is transferred to the one or more flexible members 104, which, when compressed, actuate tactile sensor 105.

Figure 1B:
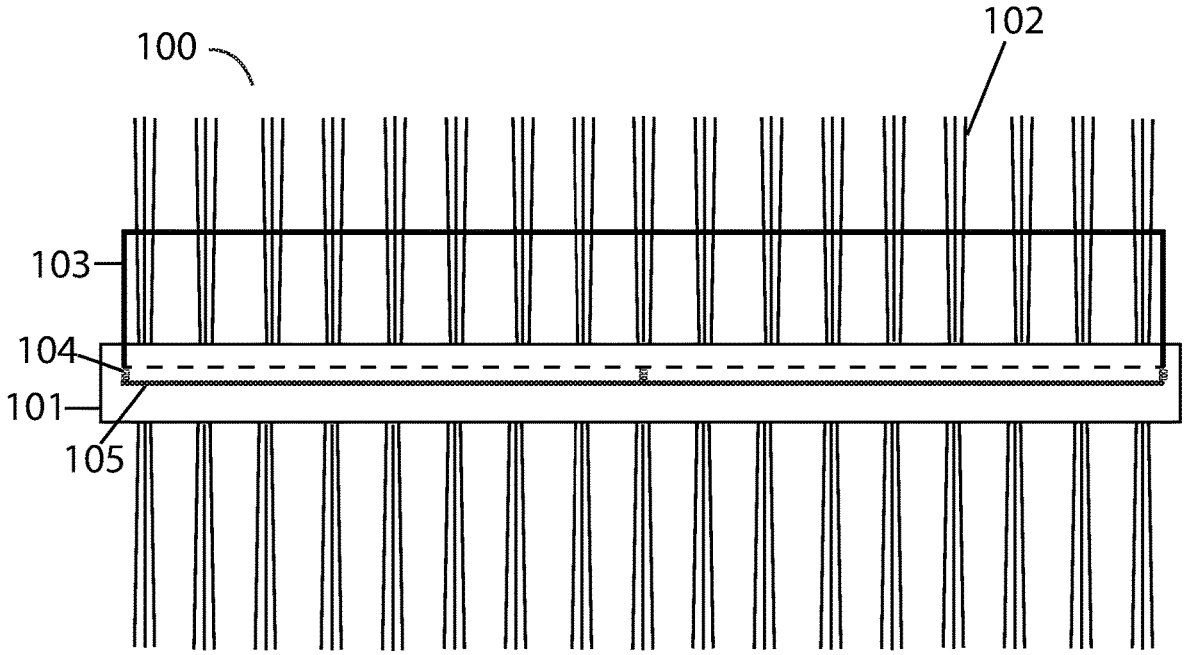
FIG. 1B illustrates a front view of a robotic vacuum brush with a pressure sensor embodying features of the present invention.

Referring to FIG. 1B, a front view of brush 100 is illustrated. Brush 100 is comprised of shaft 101 and bristles 102 projecting radially outward from shaft 101. Projecting blade 103 is disposed along the length of shaft 101 and projects through an aperture (not shown). Projecting blade 103 is attached to tactile sensor 105 via one or more flexible members 104.

Figure 2A:
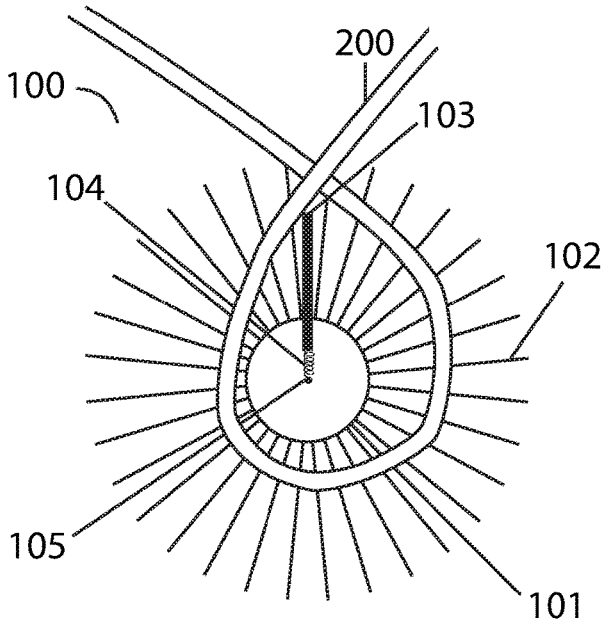
FIG. 2A illustrates a cross sectional view of a robotic vacuum brush with a pressure sensor becoming entangled with a cord embodying features of the present invention.
Figure 2B:
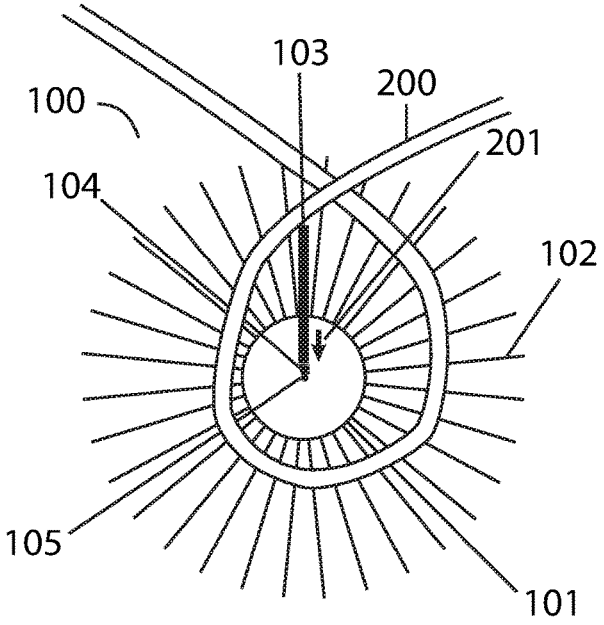
FIG. 2B illustrates a cross sectional view of a robotic vacuum brush with a pressure sensor actuated by an electrical cord entangling the brush embodying features of the present invention.

Referring to FIG. 2A, a side view of brush 100 with projecting blade 103 entangled with electrical cord 200 is illustrated. Such occurrences take place when, for example, a robotic vacuum drives over an electrical cord during operation. In this instance, electrical cord 200 has not placed enough pressure on projecting blade 103 to cause flexible member 104 to compress and actuate tactile sensor 105. Referring to FIG. 2B, a side view of brush 100 with projecting blade 103 actuated due to entanglement with electrical cord 200 is illustrated. Electrical cord 200 has become more tightly wound around brush 100, which can occur as a result of continued rotation of the brush after entanglement. Electrical cord 200 eventually puts enough pressure on projecting blade 103 to force it inward in direction 201, causing projecting blade 103 to compress flexible member 104 and actuate tactile sensor 105. Any of a variety of responses may be programmed to occur after the tactile sensor has been actuated, such as: halting rotation of the brush, reversing the rotation of the brush, temporarily reversing rotation of the brush, slowing rotation of the brush, pausing rotation of the brush, turning off a device containing the brush, activating an alert on a device containing the brush, sending or displaying a notification to a user, or altering movement or operation of the device containing the brush in any other way.

It will be obvious to one skilled in the art that the projecting blade does not need to be made of a single member and the same result can be accomplished with multiple members connected to each other or multiple members each being paired with a corresponding tactile sensor. The single projecting blade can be replaced by a plurality of shorter blades, in totality extending along the length of the shaft.

Figure 3:
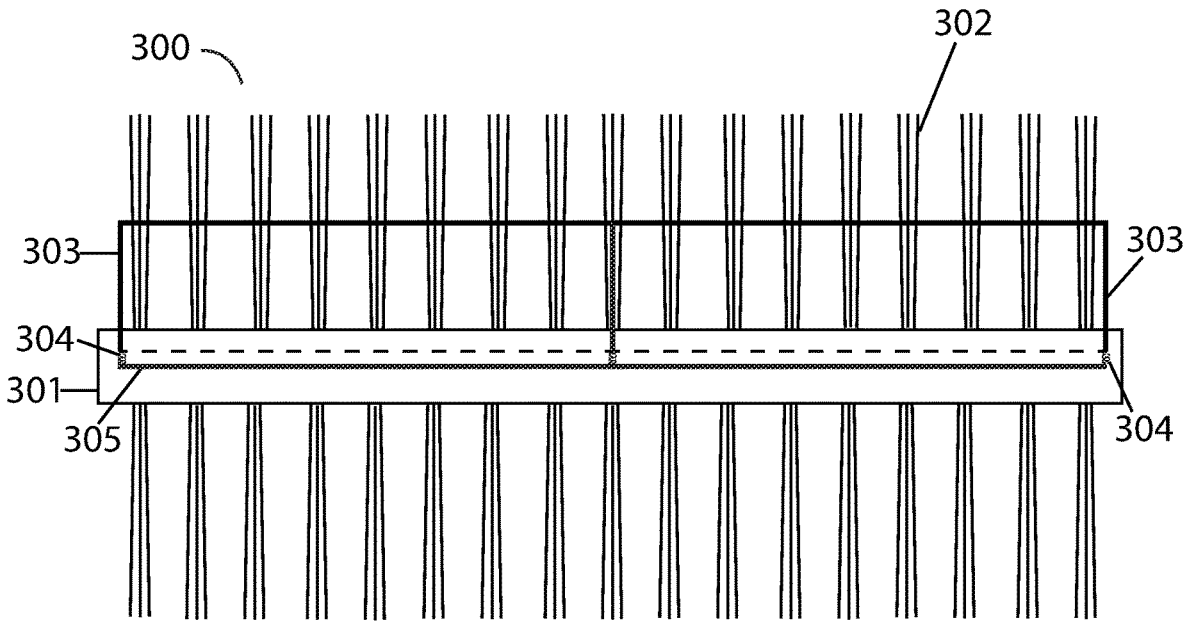
FIG. 3 illustrates an example of a robotic vacuum brush, according to some embodiments.
Figure 4:
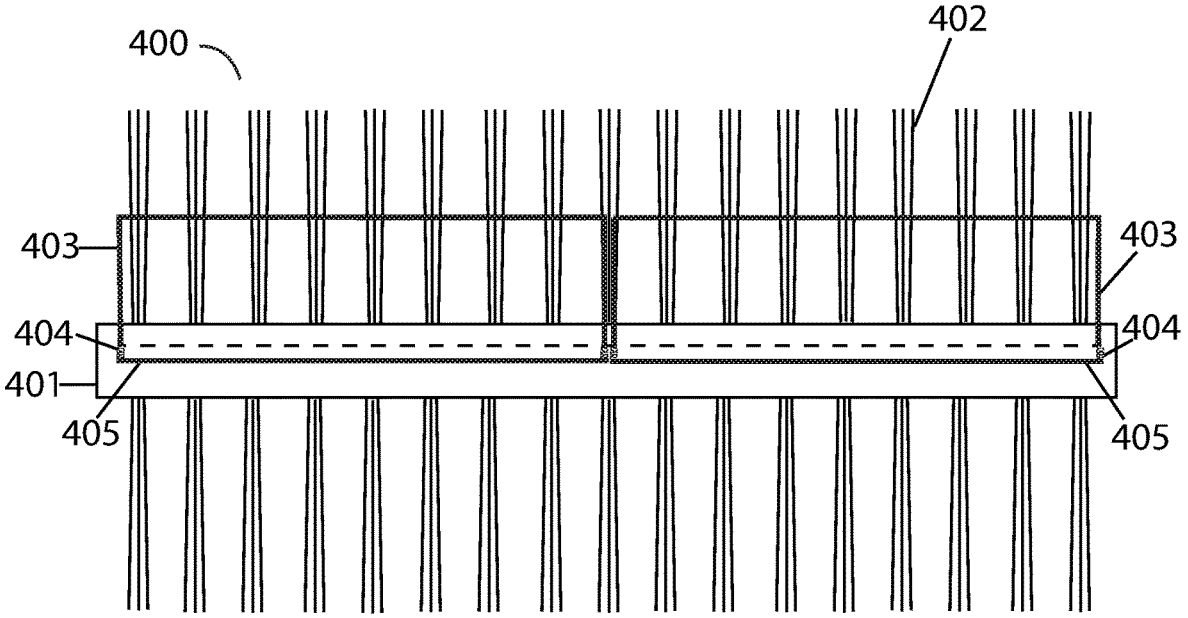
FIG. 4 illustrates an example of a robotic vacuum brush, according to some embodiments.

FIG. 3 illustrates a front view of brush 300. Brush 300 is comprised of shaft 301 and bristles 302 projecting radially outward from shaft 301. Projecting blades 303 are disposed along the length of shaft 301 and project through apertures (not shown). Projecting blades 303 are attached to tactile sensor 305 via one or more springs 304. FIG. 4 illustrates a front view of brush 400. Brush 400 is comprised of shaft 401 and bristles 402 projecting radially outward from shaft 401. Projecting blades 403 are disposed along the length of shaft 401 and project through apertures (not shown). Projecting blades 403 are each attached to tactile sensor 405 via one or more springs 404.

Figure 5:
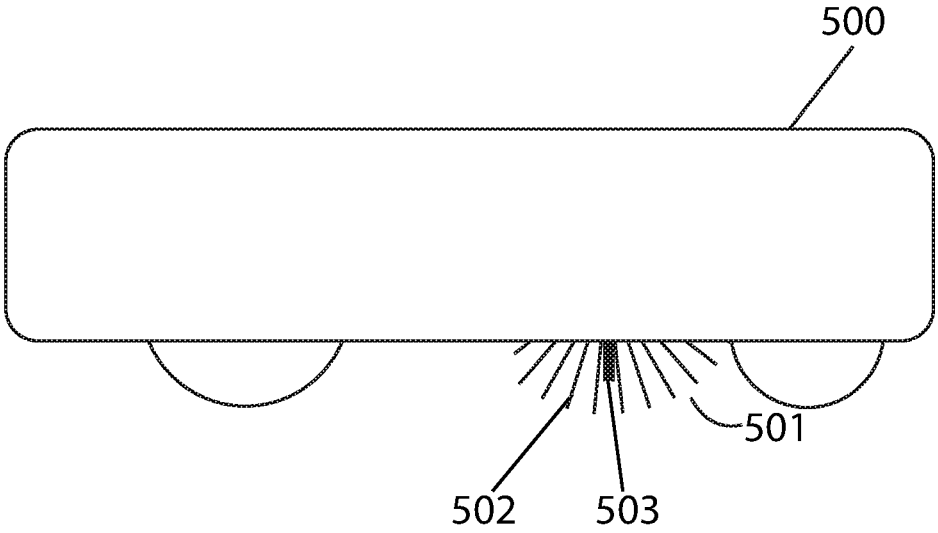
FIG. 5 illustrates an example of a robotic vacuum with a robotic vacuum brush, according to some embodiments.

FIG. 5 illustrates a side view of a robotic vacuum 500 with brush 501. Brush 501 may be a brush as described above in FIGS. 1A, 1B, 3, and 4 with bristles 502 and projecting blade 503.

The foregoing descriptions of specific embodiments of the invention have been presented for purposes of illustration and description. They are not intended to be exhaustive or to limit the invention to the precise forms disclosed. Obviously, many modifications and variations are possible in light of the above teaching. The embodiments were chosen and described in order to explain the principles and the application of the invention, thereby enabling others skilled in the art to utilize the invention in its various embodiments and modifications according to the particular purpose contemplated. The scope of the invention is intended to be defined by the claims appended hereto and their equivalents.

I claim:

1. A brush, comprising:

a rotatable shaft with a plurality of bristles radially protruding therefrom; and, a pressure sensor, comprising:

at least one projecting member extending along a length of the shaft, and a tactile sensor positioned within the shaft;

wherein the at least one projecting member comprises at least one projecting blade connected at a proximal side to the tactile sensor by at least one flexible member, a distal side of the at least one projecting blade projecting out of at least one aperture in the shaft; and wherein the tactile sensor is actuated when more than a threshold amount of pressure is put on the at least one projecting member, causing at least one of the at least one flexible member to compress and touch the tactile sensor.

2. The brush of claim 1, wherein the tactile sensor is electronically coupled to a processor.

3. The brush of claim 1, wherein the tactile sensor is any of: a mechanical sensor, an electronic pressure sensor, and a pressure actuated switch.

4. The brush of claim 1, wherein when the tactile sensor is actuated, a response is programmed to occur either immediately or after the tactile sensor has been actuated for a predetermined amount of time.

5. The brush of claim 4, wherein the programmed response includes any of the following, separately or in combination: halting rotation of the brush, reversing the rotation of the brush, temporarily reversing the rotation of the brush, slowing rotation of the brush, pausing rotation of the brush, turning off the brush, activating an alert, sending a notification to a user and, displaying a notification to a user.

6. The brush of claim 1, wherein the at least one projecting blade comprises a plurality of projecting blades, in totality extending along the length of the shaft.

7. The brush of claim 6, wherein a plurality of tactile sensors are disposed along the shaft and each projecting blade is connected to a corresponding tactile sensor, each of which is actuated individually.

8. The brush of claim 1, wherein the at least one flexible members comprises at least one springs.

9. A system for detecting and responding to brush entanglement comprising:

a brush with a rotatable shaft with a plurality of bristles radially protruding therefrom;

a tactile sensor positioned within the shaft; and, a pressure sensor comprised of at least one projecting blade positioned within an aperture in the shaft extending along a length of the shaft connected at a proximal side to the tactile sensor by a flexible member, the distal side of the projecting blade projecting out of the aperture in the shaft, wherein more than a threshold amount of pressure on the pressure sensor causes the tactile sensor to be actuated.

10. The system of claim 9, wherein the tactile sensor is electronically coupled to a processor.

11. The system of claim 9, wherein the tactile sensor is any of a mechanical sensor, an electronic pressure sensor, and a pressure actuated switch.

12. The system of claim 9, wherein actuation of the tactile sensor triggers, either immediately or after the tactile sensor has been actuated for a preset amount of time, any of the following responses, separately or in combination: halting rotation of the brush, reversing the rotation of the brush, temporarily reversing the rotation of the brush, slowing rotation of the brush, pausing rotation of the brush, and turning off the brush.

13. The system of claim 9, wherein the pressure sensor is comprised of a plurality of projecting blades, disposed at different positions around the shaft of the brush, each paired to a corresponding tactile sensor.

14. The system of claim 9, wherein the flexible members comprises a plurality of flexible members.

15. The system of claim 9 wherein the brush is disposed on a robotic vacuum.

16. The system of claim 15 wherein actuation of the tactile sensor triggers, either immediately or after the tactile sensor has been actuated for a preset amount of time, any of the following responses, separately or in combination: turning off the robotic vacuum, activating an alert on the robotic vacuum, sending a notification to a user, displaying a notification to a user, and altering the movement or operation of the robotic vacuum.

17. A method for detecting entanglement of an object about a robotic vacuum brush comprising:

providing a brush with a rotatable shaft and bristles protruding radially therefrom on a robotic vacuum;

providing a pressure sensor comprised of at least one projecting blade extending along a length of the shaft, wherein the at least one projecting blade is connected at a proximal side to a tactile sensor disposed within the shaft by at least one flexible member, a distal side of the at least one projecting blade projecting out of at least one aperture in the shaft; and, detecting entanglement of an object about the brush when more than a threshold amount of pressure on the pressure sensor causes the tactile sensor to be actuated.

18. The method of claim 17, further comprising;

upon detecting entanglement of an object about the brush, executing a preprogrammed response including any of the following, separately or in combination: halting rotation of the brush, reversing the rotation of the brush, temporarily reversing the rotation of the brush, slowing rotation of the brush, pausing rotation of the brush, turning off the robotic vacuum, activating an alert on the robotic vacuum, sending a notification to a user, displaying a notification to a user, and altering the movement or operation of the robotic vacuum.

19. The method of claim 17 wherein at least one flexible member is comprised of at least one spring.

20. The method of claim 17 wherein a plurality of projecting blades are each connected to the tactile sensor.

* * * * *